US008640580B2

(12) United States Patent
Bohne

(10) Patent No.: US 8,640,580 B2
(45) Date of Patent: Feb. 4, 2014

(54) TOOL FASTENABLE TO A DRIVE SHAFT OF A HAND-HELD POWER TOOL DRIVEABLE IN AN OSCILLATING MANNER

(75) Inventor: Ulrich Bohne, Kohlberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/371,600

(22) Filed: Feb. 13, 2012

(65) Prior Publication Data

US 2012/0144971 A1 Jun. 14, 2012

Related U.S. Application Data

(63) Continuation of application No. 10/574,683, filed as application No. PCT/EP2005/054126 on Aug. 23, 2005, now Pat. No. 8,151,679.

(30) Foreign Application Priority Data

Oct. 19, 2004 (DE) ..... 10 2004 050 798

(51) Int. Cl.
*B26D 7/26* (2006.01)

(52) U.S. Cl.
USPC ..... 83/13; 83/698.11; 83/698.41; 83/782

(58) Field of Classification Search
USPC ..... 83/698.11, 698.41, 782, 651; 30/144; 403/3, 13, 260; 606/79, 82, 176–179, 606/170, 171
See application file for complete search history.

(56) References Cited

U.S. PATENT DOCUMENTS

| | | | | |
|---|---|---|---|---|
| 3,905,374 | A * | 9/1975 | Winter | 606/178 |
| 4,252,121 | A * | 2/1981 | Arnegger | 606/53 |
| 5,366,312 | A * | 11/1994 | Raines | 403/3 |
| 6,796,888 | B2 * | 9/2004 | Jasch | 451/342 |
| 7,789,885 | B2 * | 9/2010 | Metzger | 606/88 |
| 7,833,241 | B2 * | 11/2010 | Gant | 606/176 |
| 7,837,690 | B2 * | 11/2010 | Metzger | 606/87 |
| 7,887,542 | B2 * | 2/2011 | Metzger et al. | 606/87 |
| 8,123,758 | B2 * | 2/2012 | Metzger et al. | 606/102 |

* cited by examiner

*Primary Examiner* — Omar Flores Sanchez
(74) *Attorney, Agent, or Firm* — Michael J. Striker

(57) ABSTRACT

A tool is configured with a centering element and a fastening portion with form-locking elements for axial mounting and fastening onto a drive shaft of a hand-held power tool. The centering element and the form-locking elements are arranged in a first tool part. The form-locking elements are located radially outside the centering element and are configured with a quadrangular cross section that corresponds to a trapezoidal cross section, which is perpendicular to an axis of the drive shaft.

19 Claims, 3 Drawing Sheets

TOOL FASTENABLE TO A DRIVE SHAFT OF A HAND-HELD POWER TOOL DRIVEABLE IN AN OSCILLATING MANNER

CROSS-REFERENCE TO RELATED APPLICATION

The invention described and claimed hereinbelow is a Continuation application of U.S. patent application Ser. No. 10/574,463, filed in the US on Apr. 4, 2006 ("Parent Application"), which Parent Application was described in German Patent Application DE 10 2004 050 798.8, filed in Germany on Oct. 19, 2004 "the German Patent Application). The Continuation application derives its basis for priority under 35 USC §119(a)-(d) from the Patent Application and the German Patent Application, the subject matter of both of which are incorporated by reference herein.

BACKGROUND OF THE INVENTION

The invention is based on a device for fastening an axially mountable tool to a drive shaft, drivable in oscillating fashion, of a hand-held power tool, as generically defined by the preamble to claim 1.

From European Patent Disclosure EP 1 213 107 A1, a device for fastening an axially mountable tool to a drive shaft, drivable in oscillating fashion, of a hand-held power tool, is known. This device includes a centering recess and six form-locking elements, which are embodied as tips in an outline of their centering recess and are therefore part of the centering recess.

SUMMARY OF THE INVENTION

The invention is based on a device having a centering element and at least one form-locking element for fastening an axially mountable tool to a drive shaft, which is drivable in an oscillating manner, of a hand-held power tool in which the centering element is provided for centering the tool relative to the drive shaft, and the form-locking element is provided for defining a rotary position of the tool relative to the drive shaft.

It is proposed that the form-locking element is located radially outside the centering element. As a result, an advantageous separation of a centering function from a defining function and/or a torque transmission function can be achieved, so that a more-comfortable fastening process is attainable. Because the form-locking element is located radially on the outside, an advantageously long lever for transmitting torque can be achieved, with comparatively little material stress in the region of the form-locking element, without losing precision in a centering operation.

The term "intended" is to be understood in this respect to mean "designed" and "equipped".

In an embodiment of the invention, it is proposed that the centering element has a circular cross section. As a result, it can be attained that after the centering operation, the rotary position is freely selectable and is independent of the centering operation. The centering element can be embodied either as a circular recess or as a bolt with a circular cross section.

A sturdier and more secure form lock can be attained if the form-locking element is intended for engagement in a recess. However, embodiments of the invention are also conceivable in which the form-locking element is formed by a set of teeth, for instance, and is intended to mesh with a corresponding set of teeth. A more-secure hold of the form-locking element is attainable if the form-locking element has at least one axially extending bearing face.

If the form-locking element is intended for fastening the tool in at least three rotary positions, then the device can advantageously be suitable for fastening a tool with three possible working positions, in particular a tool with triple symmetry, for instance a triangular grinding plate.

If the form-locking element is intended for fastening the tool in at least four rotary positions, then the device can advantageously be intended for fastening a tool with four possible working positions, and particularly for fastening a tool with quadruple symmetry or with working positions that differ by 90°. As an example, a circular saw blade can be named.

A device that can be used universally for many different kinds of tools can be attained if the form-locking element is intended for fastening the tool in at least twelve rotary positions. Especially if the rotary positions are distributed uniformly over an angular range, flexible adjustment with simultaneously more-secure torque transmission is attainable.

A rotationally symmetrical device is attainable if the angular range amounts to 360°. Especially in the case of a twelve-fold rotational symmetry, a device that can advantageously be used for tools both with triple symmetry and with quadruple symmetry is attainable, which is suitable especially both for fastening a triangular grinding plate and a circular saw blade.

Torque transmission with little material stress and simultaneously more-precise centering of the tool can be attained if a radius associated with one position of the form-locking element is more than twice as large as a radius of the centering element. If a plurality of form-locking elements is located on a circle, the radius of the circle can be associated with the form-locking elements, and otherwise, the radial spacing of the form-locking element or one edge of it, from an axis of rotation of the drive shaft can be associated with them.

An economical, safe form-locking element is attainable if the form-locking element is embodied in pin-like form.

If the device has a plurality of identically shaped form-locking elements, distributed uniformly over a circle around the centering element, then an asymmetrical load on the device upon torque transmission can be avoided.

Point-wise stress on material can be avoided if the form-locking element has at least one slaving face, oriented substantially in the circumferential direction. The direction of the face is determined by the surface normal. A precise-fitting slaving face, or a bearing face corresponding to the slaving face, can be attained structurally simply if the slaving face is embodied as flat. Comfortable guidance into an engagement rotary position of the form-locking element is attainable if the form-locking element has at least one chamfer for reinforcing a slip-on operation.

Play-free fastening can be attained and an overload on the device can be avoided if the device includes a spring element for generating a clamping force on the tool. A set-point torque of the device can be made clearer to a user if a blocking force of the spring element is associated with a rated torque of a fastening element, in particular a screw.

A cost-saving device can be attained if the centering element is embodied as a fastening screw.

If the spring element is embodied as a cup spring, it can advantageously be capable of being manufactured inexpensively, and the contact-pressure flange can be useful for axially pressing the tool against the drive shaft.

Sufficiently precise centering with adequate stability is attainable if the diameter of the centering element amounts to between 4 and 8 mm.

The invention is also based on a tool, having a centering element and a form-locking element for axial mounting and fastening onto a drive shaft, drivable in oscillating fashion, of a hand-held power tool, in which the centering element is intended for centering relative to the drive shaft and the form-locking element is intended for defining a rotary position relative to the drive shaft.

It is proposed that the form-locking element is located radially outside the centering element. As a result, a tool can be attained that can be fastened in a fastening operation to the drive shaft, which operation includes an operation, independent of the centering operation, for determining the rotary position.

A secure form-locking connection between the tool and the drive shaft is attainable if at least one corresponding form-locking element of the drive shaft is associated with the form-locking element.

An especially economical replaceable tool can be attained if the form-locking element is embodied as a recess. However, embodiments of the invention are also conceivable in which the form-locking element is embodied as a raised bulge that engages a recess on the drive shaft.

BRIEF DESCRIPTION OF THE DRAWINGS

Further advantages will become apparent from the ensuing description of the drawings. In the drawings, exemplary embodiments of the invention are shown. The drawings, description and claims include numerous characteristics in combination. One skilled in the art will expediently consider these characteristics individually as well and put them together to make useful further combinations.

DESCRIPTION OF THE INVENTION

Figure 1:
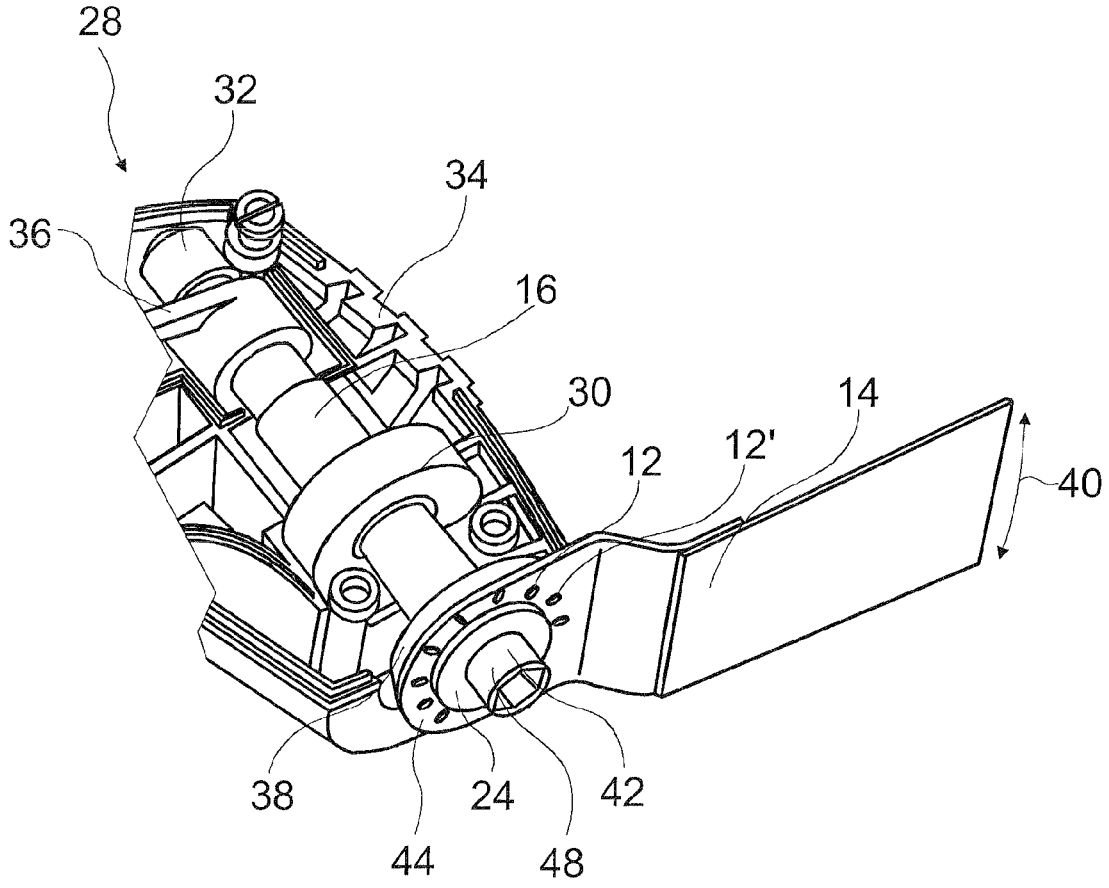
FIG. 1 depicts a hand-held power tool with a centering element and a form-locking element for fastening an axially mountable tool.

FIG. 1 shows a hand-held power tool 28 with a drive shaft 16 which is drivable in oscillating fashion and is supported, via a ball bearing 30 and a needle bearing 32, in a housing 34 of the hand-held power tool 28, half of the housing having been removed in the drawing. The hand-held power tool 28 includes an electric motor, not shown here, which via a motor shaft drives an eccentric disk the inside of which is engaged by an arm 36, connected to the drive shaft 16 in a manner fixed against relative rotation, so that a rotary motion of the eccentric disk generates an oscillatory motion of the arm 36 and thus of the drive shaft 16.

On an end of the drive shaft 16 protruding from the housing 34, the hand-held power tool 28 has a device for fastening an axially mountable tool 14, which device includes a plate-like bearing flange 38, a fastening screw 42, and a spring element 24 embodied as a cup spring. The device serves to provide a rotationally and axially fixed connection between the tool 14 and the drive shaft 16, so that the oscillating motion of the drive shaft 16 is converted into an oscillating pivoting motion 40 of the tool 14.

The bearing flange 38 has a circular bearing face, which extends perpendicular to the drive shaft 16 and on which a total of twelve pin-like form-locking elements 12 of trapezoidal cross section are distributed uniformly over an angular range that is defined by the entire circumference of the circle. In the middle of the bearing flange 38, a centering element 10 (FIG. 2) embodied as a blind bore is mounted, with a female thread, not shown here, for receiving the fastening screw 42.

Figure 4:
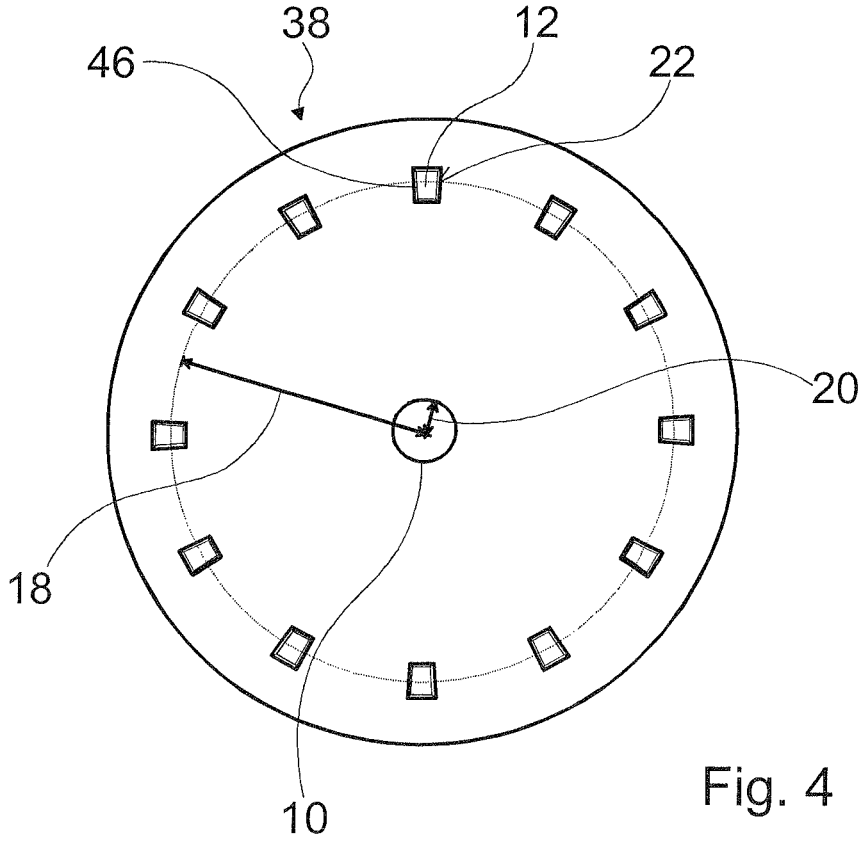
FIG. 4 depicts a bearing flange of the hand-held power tool of FIGS. 1 through 3.

The form-locking elements 12 are located radially outside the centering element 10. The radius 18 of the circle on which the form-locking elements 12 are located exceeds the radius 20 of the centering element 10 by a factor of four. The form-locking elements 12 have lateral slaving faces 22, which extend radially outward, relative to the axis of rotation of the drive shaft 16, as well as axially. On an edge facing away from the body of the hand-held power tool 28, the form-locking elements 12 also have a chamfer 46 for reinforcing a slip-on operation of the tool 14 (FIG. 4).

Figure 3:
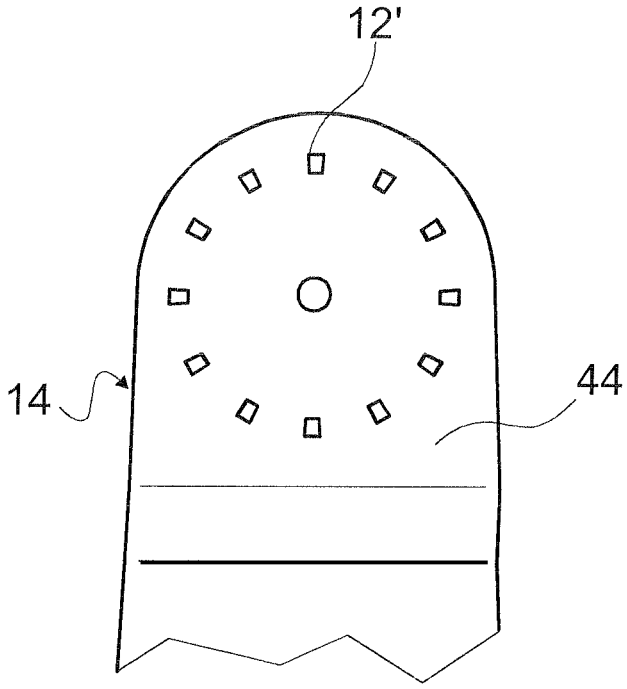
FIG. 3 depicts a detail of the tool of FIGS. 1 and 2.

The tool 14 is part of a large assortment of possible insert tools, which includes circular saw blades, milling cutters, grinding plates, and cutting tools. In a fastening portion 44, which is identical in all the tools of the assortment, the tool 14 has twelve form-locking elements 12', located in a circle and embodied as recesses or holes, which correspond to the form-locking elements 12 on the bearing flange 38. The form-locking elements 12' have a shape that corresponds to the trapezoidal cross section of the form-locking elements 12 (FIG. 3).

In an installed state of the tool 14, the form-locking elements 12 reach through the form-locking elements 12' and define a rotary position of the tool 14 relative to the drive shaft 16. Because of the twelve-fold symmetry of the arrangement of form-locking elements 12, 12', the device is suitable for defining twelve different rotary positions of the tool 14 relative to the drive shaft 16, and these positions differ from each of their adjacent rotary positions by 30° each. Each rotary position corresponds to a different association between the form-locking elements 12 and the form-locking elements 12'.

Figure 2:
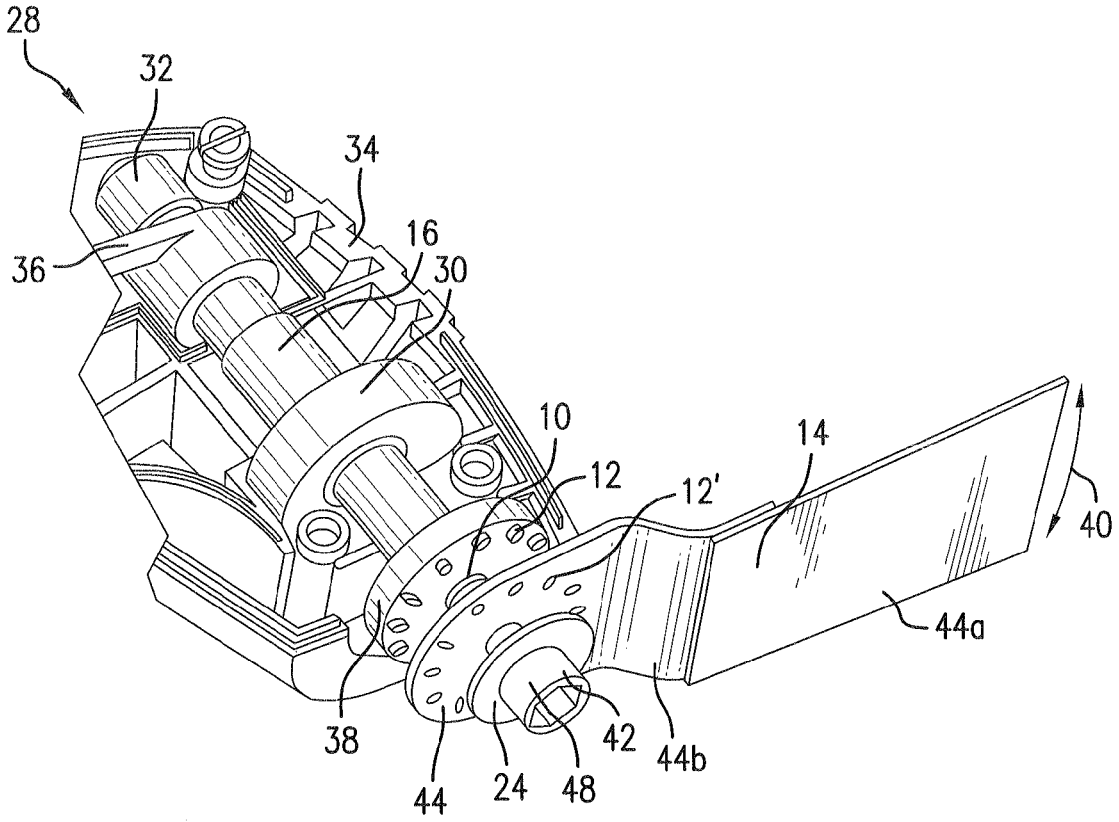
FIG. 2 depicts the hand-held power tool of FIG. 1 in a configuration of a centering operation.

In the center of the fastening portion 44 and of the circle on which the form-locking elements 12' are located, the tool 14 has a round hole, whose diameter amounts to 6 mm and thus corresponds to the diameter of a shaft of the fastening screw 42. The fastening portion 44 is arranged in parallel to a second tool part 44*a* that is connected to fastening section 44 via an inclined section 44*b* (FIG. 2).

During an installation operation, a user pushes the fastening screw 42, provided with the spring element 24, through the round hole in the fastening portion 44 and introduces the fastening screw 42 into the centering element 10, embodied as a blind bore, in the bearing flange 38. A head 48 of the fastening screw 42 has a hexagonal recess for receiving a hex wrench.

By screwing the fastening screw 42 into the centering element 11, the tool 14 is displaced past the spring element 24, acting as a contact-pressure flange, in the direction of the bearing flange 38, until the tool 14 comes into contact with the form-locking elements 12. By rotating the tool 14, the user can now determine the rotary position relative to the drive shaft 16. In the process, by a contact pressure generated by the spring element 24, the tool 14 is automatically deflected past the chamfers 46 of the form-locking elements 12 into one of the twelve rotary positions in which the tool 14 can be fixed. Centering of the tool 14 is made more precise by the intermeshing of the form-locking elements 12, 12', and especially by the contact of a radially inward-pointing side face of the form-locking elements 12 with a radially inner edge of the form-locking elements 12'.

Once the form-locking elements 12 have entered into engagement with the form-locking elements 12', the user tightens the fastening screw 42 further, until the tool 14 is pressed by the spring element 24 against the bearing face of the bearing flange 38. The spring element 24 becomes fully compressed once a rated torque of the fastening screw 42 is attained, which is perceptible to the user from a sudden increase in a torque required to turn the fastening screw 42. The spring element 24 then generates a clamping force, dictated essentially by the blocking force, with which clamping force the tool 14 is held without play on the bearing face of the bearing flange 38.

What is claimed is:

1. A method for fastening an axially mountable tool to a driven shaft of a hand-held power tool, comprising steps of:

attaching said tool with a fastening portion to said drive shaft until said tool is in contact with a bearing shaft that is mounted on said drive shaft, wherein said fastening portion of said tool comprises twelve tool form-locking elements which correspond to twelve flange form-locking elements of said bearing flange;

attaching a fastening screw to said drive shaft, wherein said fastening screw comprises a spring element embodied as a cup spring to act as a contact pressure flange;

inserting said fastening screw through a round hole located in a center of said tool;

screwing said fastening screw into a centering element of said bearing flange;

rotating said tool to determine a rotary position relative to said drive shaft, wherein said tool is automatically deflected by a contact pressure generated by said spring element past chamfers of said flange form-locking elements into a rotary position in which said tool can be fixed; and tightening said fastening screw to press said tool via said spring element against a bearing face of said bearing flange, wherein said spring element generates a clamping force to fixedly mount said tool to said drive shaft.

2. A tool, comprising:

a centering element embodying a blind bore; and a fastening portion with tool form-locking elements for axial mounting and fastening onto a drive shaft of a hand-held power tool;

wherein said drive shaft is drivable in oscillating fashion, wherein said centering element centers relative to said drive shaft and said tool form-locking elements define a rotary position relative to said drive shaft, wherein said tool form-locking elements are located radially outside said centering element, wherein said centering element and said tool form-locking elements are arranged in a first tool part, the first tool part arranged in parallel to a second tool part that is connected to said first tool part via an inclined section, wherein said tool form-locking elements have a quadrangular cross section that corresponds to a trapezoidal cross section, which is perpendicular to an axis of the drive shaft (16), of flange form-locking elements of a bearing flange of a device for fastening said tool to said drive shaft of said hand-held power tool, and wherein said tool form-locking elements are distributed uniformly over an angular range that is defined by the entire circumference of circular face of said fastening portion.

3. The tool as recited in claim 2, wherein a spring element is arranged in a plane which is located between a plane of said first tool part and a plane of said second tool part.

4. A device, comprising:

a centering element (10) embodying a blind bore, a bearing flange (38) comprising a circular bearing face; and twelve flange form-locking elements (12) located on said bearing flange (38) for fastening an axially mountable tool (14) to a drive shaft (16) of a hand-held power tool (26);

wherein said tool (26) is drivable in an oscillating fashion, wherein said centering element (10) is provided for centering said tool (14) relative to said drive shaft (16), wherein said twelve flange form-locking elements (12) are provided for defining a rotary position of said tool (14) relative to said drive shaft (16), wherein each of said twelve flange form-locking elements (12) has at least one slaving face (22) extended radially outward and in an axial direction relative to an axis of the drive shaft (16), wherein said twelve flange form-locking elements (12) are located radially outside said centering element (10), wherein said twelve flange form-locking elements (12) are distributed uniformly over an angular range that is defined by an entire circumference of said circular bearing face, and wherein said twelve flange form-locking elements (12) have a quadrangular cross-section which is perpendicular to an axis of the drive shaft (16).

5. The device as recited in claim 4, wherein at least one of four edges forming the quadrangular cross-section of each of the twelve form-locking elements is a rounded edge.

6. The device as recited in claim 4, wherein a radius associated with one position of said twelve flange form-locking elements (12) is four times as large as a radius of said centering element (10).

7. The device as recited in claim 4, wherein said twelve flange form-locking elements (12) are configured to operate with at least one axially mountable tool having a triple symmetry and with at least one axially mountable tool having a quadruple symmetry.

8. The device as recited in claim 7, wherein said at least one axially mountable tool (14) is a cutter tool.

9. The device as recited in claim 4, wherein each of said twelve flange form-locking elements (12) has a chamfer (46) for reinforcing a slip-on operation.

10. The device as recited in claim 4, wherein the centering element (10) has a circular cross section.

11. The device as recited in claim 4, wherein each of said twelve flange form-locking elements (12) is intended for engagement in a recess (12') in an axially mountable tool.

12. The device as recited in claim 4, wherein the rotary positions are distributed uniformly over an angular range of 360°.

13. The device as recited in claim 4, wherein a radius (18) associated with the rotary position of said twelve flange form-locking elements (12) is more than twice as large as a radius (20) of the centering element (10).

14. The device as recited in claim 4, wherein each of said twelve flange form-locking elements embody a pin-like form.

15. The device as recited in claim 4, wherein each of said twelve flange form-locking elements (12) have at least one slaving face (22), oriented substantially in the circumferential direction.

16. The device as recited in claim 15, wherein the slaving face (22) is flat.

17. The device as recited in claim 2, wherein a spring element (24) generates a clamping force on the tool (14).

18. The device as recited in claim 16, wherein a blocking force of the spring element (24) is associated with a rated torque of a fastening screw (42).

19. The device as recited in claim 4, wherein a diameter of the centering element (10) is between 4 and 8 mm.

* * * * *